United States Patent [19]

Pawlowski

[11] Patent Number: 5,045,330

[45] Date of Patent: Sep. 3, 1991

[54] BIASED FOOD CONTACT CONTAINER AND CONTAINER INSERT

[75] Inventor: Thomas D. Pawlowski, Neenah, Wis.

[73] Assignee: James River Corporation, Richmond, Va.

[21] Appl. No.: 397,197

[22] Filed: Aug. 23, 1989

[51] Int. Cl.[5] ..... B65D 85/00

[52] U.S. Cl. ..... 426/ 107; 219/10.55 E; 426/113; 426/124; 426/243

[58] Field of Search ..... 426/107, 113, 234, 243, 426/124; 229/902, 903; 219/10.55 E

[56] References Cited

U.S. PATENT DOCUMENTS

| | | | |
|---|---|---|---|
| 3,591,751 | 7/1971 | Goltsos | 219/10.55 E |
| 4,141,487 | 2/1979 | Faust et al. | 229/903 |
| 4,230,924 | 10/1980 | Brastad et al. | 219/10.55 E |
| 4,267,420 | 5/1981 | Brastad | 219/10.55 E |
| 4,590,349 | 5/1986 | Brown et al. | 219/10.55 E |
| 4,594,492 | 6/1986 | Maroszek | 219/10.55 E |
| 4,626,641 | 12/1986 | Brown | 219/10.55 E |
| 4,734,288 | 3/1988 | Engstrom et al. | 426/107 |
| 4,777,053 | 10/1988 | Tobelman et al. | 426/107 |

*Primary Examiner*—Donald E. Czaja
*Assistant Examiner*—A. J. Weier
*Attorney, Agent, or Firm*—Sixbey, Friedman, Leedom & Ferguson

[57] ABSTRACT

An improved container for use in microwave cooking includes an insert which maintains a microwave interactive material in contact with a food product during cooking. The isnert includes flaps or wing sections which bias a central panel towards the food, with the microwave interactive material associated with the central panel. To ease in handling prior to and during packaging, an adhesive restrains the bias flaps until the adhesive is at least partially melted during cooking. The insert may be arranged to prevent excessive bowing or curling of the central panel, and to improve venting or draining of fluids from the food product.

20 Claims, 5 Drawing Sheets

FIG. 4A
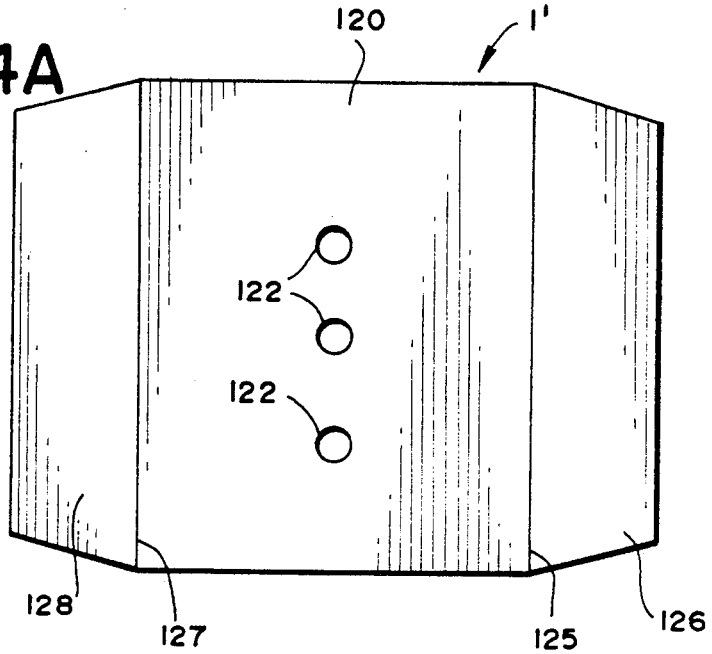
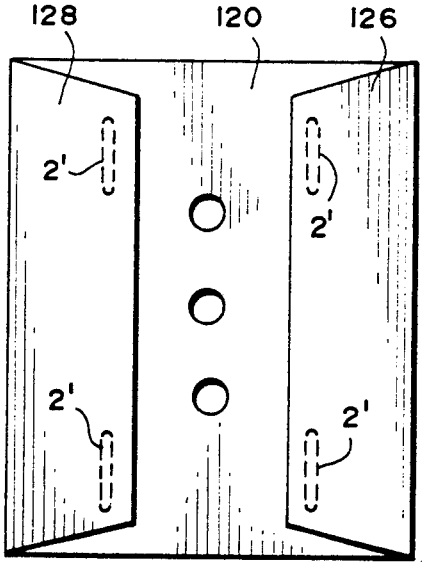
FIG. 4B
FIG. 5
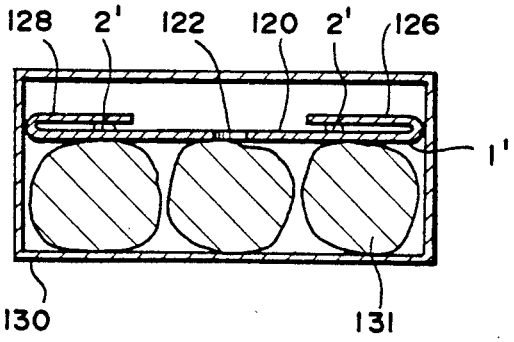

BIASED FOOD CONTACT CONTAINER AND CONTAINER INSERT

TECHNICAL FIELD

The invention relates to microwave food packages and more particularly to a food package which will cook the outer surface of a food product by microwave browning or crisping.

BACKGROUND ART

Microwave cooking has experienced substantial growth due to the convenience and time savings associated with microwave cooking. However, often consumers are dissatisfied with food cooked in microwave ovens since they often lack many of the characteristics associated with a particular food cooked in a conventional oven. In particular, often the exterior surfaces of a food cooked by microwave energy is soggy or lacks the desired degree of browning or crispness. Various attempts have been made to provide microwave cooked-in food packages which are adapted to provide browning, however none of these attempts have provided an entirely satisfactory package which is usable for shipping, selling, storing and serving of a packaged food.

One approach, as disclosed in Brastad U.S. Pat. No. 4,267,420 and Brastad et al. U.S. Pat. No. 4,230,924 , utilizes flexible sheets of microwave interactive materials wrapped closely about individual items of food so that the interactive material converts at least a portion of the impinging microwave energy into heat which can brown the food surface. However, flexible dielectric wrapping materials can have leakage and/or venting problems for foods having fluid such as grease or vapor driven out of the food during heating, such as breakfast sausages. In addition, the consumer may find it cumbersome to remove sheets from individual food items, particularly where the food items are hot after cooking. Flexible wrapping sheets are also not suitable for shipping or display, and therefore an additional outer carton is required.

Goldsuse U.S. Pat. No. 3,591,751 discloses a microwave cooking implement in which both the top and bottom surfaces of a food article are in contact with means for converting microwave energy into heat for browning the food. The upper browning means includes a plurality of metal rods which are gravity biased into contact with the food, however incorporating bulky metal rods into an outer carton would be difficult and costly.

In another approach, as disclosed in Tobelmann et al. U.S. Pat. No. 4,777,053 upper and lower heating elements are secured to the inner surface of a carton so as to contact the surface of a food article contained therein to provide browning. However, the heating panels are fixed to the upper and lower surfaces of the carton and thus when the food shrinks during cooking, the heating panels lose contact with the food surface and the browning effect is diminished.

Maroszek U.S. Pat. No. 4,594,492 discloses a resiliently biased browning insert for a microwave package in which a pair of flanges are provided on a panel having a microwave interactive layer for browning thereon. The flanges are folded back such that when the insert is placed inside a microwave package, the folded-back flanges bias the panel having the microwave interactive layer thereon toward the food product. Thus, the flanges or wing sections press against the upper portion of the carton to resiliently bias the interactive portions into contact with the food surface. However, since the flanges are biased from the central section having the microwave interactive layer thereon, it is difficult to properly place the insert within the carton while insuring the flanges are properly folded in the biased condition and providing contact with the food product. In addition, the microwave heating insert has a tendency to curl during heating which will reduce contact of the insert with the food articles, diminishing the browning ability of the insert. Moreover, due to the weight of the food product, the biasing effect may be reduced due to repeated bending of the bias flaps as where the container is turned over or shaken during handling. This may cause fatigue in the bias which can reduce the effectiveness in maintaining the browning layer in contact with the food surface.

SUMMARY OF THE INVENTION

It is thus an object of the present invention to provide an improved disposable package for heating a food product in which a microwave interactive layer is maintained in contact with upper and lower surfaces of the food product.

It is another object of the present invention to provide an improved package for storing and heating food by microwave energy in which a microwave interactive layer forming browning means is biased toward the food product and curling of the microwave interactive portion of the package is prevented. It is a further object of the present invention to provide a microwave interactive panel which is biased towards the food product within a container, in which the biasing device is restrained during packaging.

It is yet another object of the present invention to provide a microwave interactive panel for browning of a food product in which the panel is biased towards the food product only after the package has been heated.

These and other objects and advantages of the invention are achieved by a microwave cook-in disposable package including an outer carton formed of a one-piece microwave paperboard blank and a pair of opposed microwave interactive layers adapted to sandwich food located within the carton. At least one of the microwave interactive layers is urged by a biasing means towards the other layer to press one of the microwave layers into contact with the food and to urge the food into contact with the other microwave interactive layer so that opposed surfaces of the food can be browned. The biasing means includes a paperboard spring device in which flanges from at least one of the microwave interactive layers are folded back such that the folded back flanges or flaps bias the microwave interactive layer away from the carton toward the food product. The flanges are initially folded back and affixed to the panel having a microwave interactive layer such that the flanges do not exert a biasing force against the carton or food product during packaging. Since the flanges forming the bias means are restrained during packaging, handling of the insert prior to and during packaging is much simpler. The flanges are fixed to the central panel using an adhesive which will release the flanges after the adhesive has been heated, thereby releasing the biasing means during cooking such that the microwave interactive panel is biased into contact with the food product. The adhesive acts as a restraint which imposes a controllably variable restraining force on the biasing means, such that at certain temperatures (such as those associated with storage) the bias is restrained, while at elevated temperatures (such as those associated with cooking) the restraining force is released.

In accordance with another aspect of the present invention, the flanges can be configured to prevent curling of the microwave interactive panel, thereby improving contact between the microwave interactive panel and the food product and improving the browning ability of the microwave interactive panel.

The above as well as other advantages of the present invention will be realized from the following detailed description of the invention read in conjunction with the drawings.

BRIEF DESCRIPTION OF THE DRAWINGS

FIGS. 4A and 4B are schematic layouts of an alternate form of a blank for forming a paperboard spring insert.

FIG. 5 is a cross-sectional view of a container having a restrained paperboard insert.

DESCRIPTION OF THE PREFERRED EMBODIMENT

Figure 1:
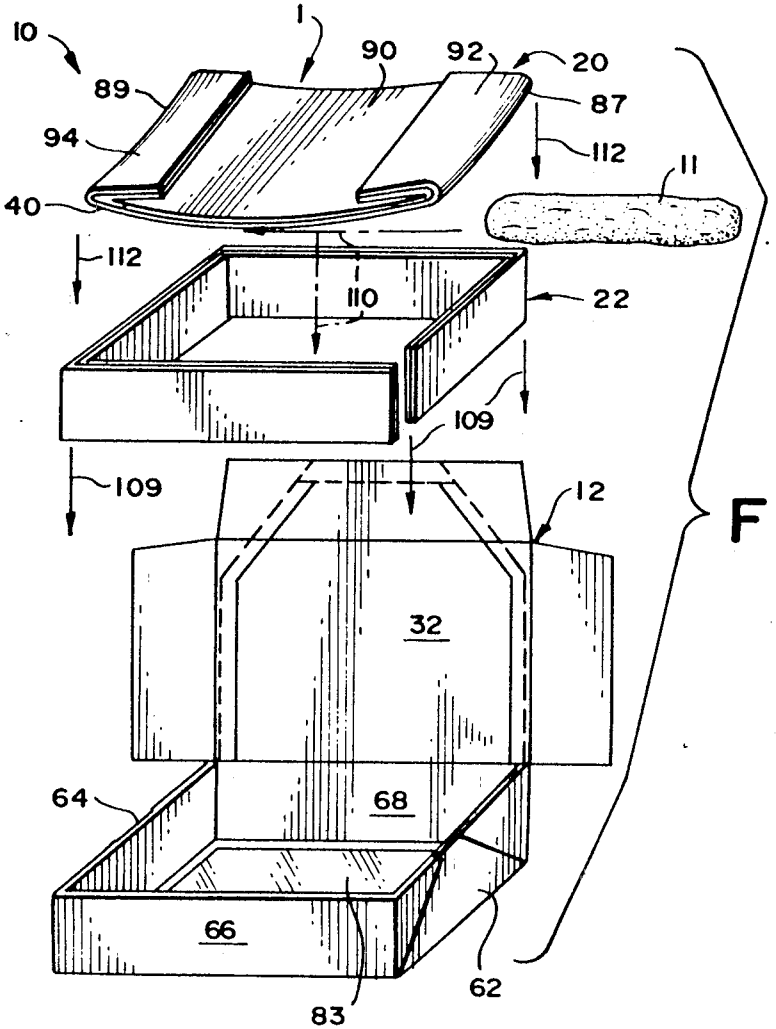
FIG. 1 is an exploded perspective view of a package utilizing a paperboard spring with restrained bias means in accordance with the present invention.

FIG. 1 shows an exploded view of a package 10 which includes a carton 12 having side walls 62, 64, 66, 68, bottom wall 83 and top wall 32. If desired, a microwave shielding means 22 may be provided in a folded condition such that the shielding means surrounds the interior food cavity formed by the carton. The microwave shielding means includes a strip of microwave impervious material such as a sufficiently thick layer of aluminum foil, laminated to a paperbacking layer. The shielding means operates by blocking the paths of entry through the side walls of the carton 10, thereby forcing a greater proportion of the available microwave energy to impinge upon the surface heating device for browning or crisping the food product in the package (discussed hereinafter). The shielding means is placed in the open tray in the direction indicated by arrows 109. A food product 11, such as a sausage link, is placed within the carton in the direction illustrated by arrows 110, and finally the insert 1 is placed in the top of the carton as illustrated by arrows 112.

As shown in FIG. 1, in accordance with the present invention the insert 1 includes bias means 20 which are initially restrained such that the flaps 92, 94 of the bias means 20 are held to the center panel 90 of the insert 1. A suitable adhesive such as a hot melt is utilized for retaining the flaps 92, 94 to the center panel 90 such that the inserts may easily be stacked for storing or shipping, and conveniently placed in the carton during packaging.

The insert includes a microwave interactive layer 40 (shown in FIG. 1 in an exaggerated thickness for illustrative purposes). The microwave interactive layer is laminated to the insert 1 such that the surface of the central panel 90 facing the interior of the carton (i.e., the side facing the food product) is coated with the microwave interactive layer. The microwave interactive layer may take the form of a metalized layer of polyester film, or more particularly an extremely thin layer of aluminum which has been vapor deposited on the polyester film to a thickness of only a few microns such as disclosed in U.S. Pat. No. 4,641,005. At this thickness, the aluminum layer interacts with microwaves by heating up to a temperature hot enough to brown and crisp food in contact therewith. The polyester film may also be adhered to a paper carrier layer which in turn may be adhered to the paperboard blank of the insert 1. A large number of other microwave interactive materials may also be used. Examples of other suitable interactive materials are disclosed in Turpin U.S. Pat. No. 4,190,757.

Portions of the microwave interactive material may be focused off of the bias flaps 92, 94. Where scorching is a problem, portions of the microwave interactive layer on the flaps and/or the central panel may be eliminated through a focusing process to reduce scorching of the insert. It should also be understood that various patterns of the microwave interactive material may be formed to focus heating at desired areas. For example, if it is realized that a certain portion of a food product is overcooked, the microwave interactive material can be focused to reduce the amount of heating in the area associated with the overcooked portion.

In accordance with the present invention, the adhesive utilized for restraining the flaps 92, 94 is a temperature sensitive adhesive, such as a hot melt, which melts as the temperature is raised during cooking. Thus, when the package is placed in a microwave oven, the microwave energy causes the insert 1 to heat up rapidly due to the microwave interactive layer 40. As a result, the hot melt adhesive melts releasing flaps 92, 94 and the bias of the flaps imposes a spring force on the panel 90 against top wall 32 such that the central panel 90 is biased into contact with the food, thereby maintaining contact between the microwave interactive layer and the food surface even if the food shrinks during cooking.

Figure 2:
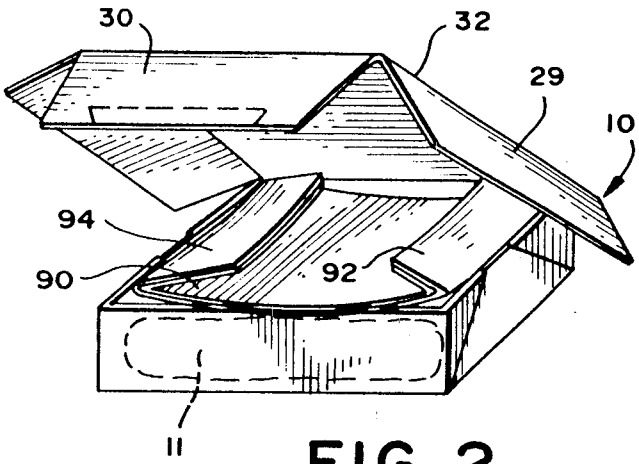
FIG. 2 is a perspective view of the package of FIG. 1, with the bias means unrestrained.

FIG. 2 shows an insert with the bias flaps 92, 94 released as would be the condition after cooking. If desired, scores or perforations may be provided in the carton to ease opening of the package after cooking. The insert in accordance with the present invention provides significant advantages over the prior art paperboard bias devices. Significantly, the insert having restrained blanks is much easier to handle, since they may be stacked more easily prior to insertion into a container, and special handling of the flaps during insertion into the container is not needed. For example, if a carton top were closed by an unrestrained bias means, one of the flaps may become lodged or caught in a side flap of the cover (such as shown at 29 in FIG. 2). In addition, if an unrestrained flap is standing upright as the carton is closed, the flap may be broken by the cover which may further result in buckling of the center panel or distortion of the top panel 32 of the carton. The above problems may result in an unusable package, or one in which satisfactory contact of the microwave interactive layer with the food is not attained.

Figure 3:
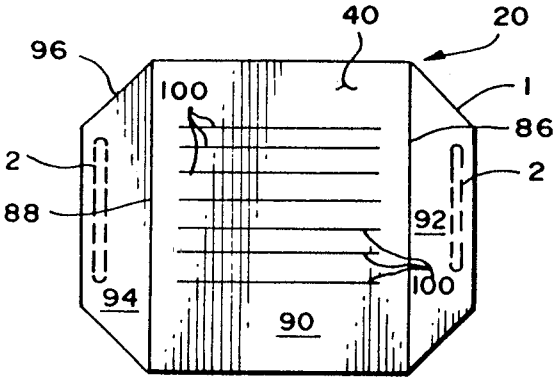
FIG. 3 is a schematic layout of a blank used for forming the paperboard spring insert in accordance with the present invention.

As shown in FIG. 3, the insert blank 1 includes a pair of crushed fold lines 86, 88 in a somewhat parallel condition and extending between opposed sides of the blank to divide the blank into three sections including the central section 90 which is generally planar when unbiased. The central panel 90 has a perimeter shape corresponding generally to the inside horizontal cross-sectional configuration of the interior food cavity of the carton 12. It is to be understood that the insert in accordance with the present invention may be utilized with a wide range of microwaveable packages in addition to that shown in FIG. 1. The size and shape of the insert may be modified to fit conveniently in other types of containers.

Fold lines 86, 88 define a pair of flap or wing sections 92, 94 connected to opposed side edges of the central section 90. Fold lines 86, 88 may be configured in a manner to cause the central section 90 to be flexed into a non-planar configuration as the wing sections are folded inwardly, thereby to cause the flaps to be biased back toward the plane defined by the central section 90. If desired, the microwave interactive layer 40 may be cut scored along parallel lines 100 extending transversely between fold lines 86, 88. These cut score lines may be utilized if lamination of the metalized layers is found to hinder the desired resilience of the support layer. It has also been recognized that it is highly desirable to orient the grain of the paperboard support layer such that it extends transversely between the fold lines 86 and 88 to augment the strength and resilience of the biasing means 20. Further details of the carton of FIG. 1 may be found in Maroszek U.S. Pat. No. 4,595,492 which is incorporated herein by reference.

As shown in FIG. 3, a line of adhesive 2 is provided on each of the flaps 92, 94 for fixing the flaps to the central panel 90. The adhesive acts as a restraint which imposes a controllably variable restraining force on the biasing means, such that at certain temperatures (such as those associated with storage) the bias is restrained, while at elevated temperatures (such as those associated with cooking) the restraining force is released. The adhesive lines are shown in broken line in FIG. 3 since they would be placed on the side of the insert which is opposite to the side having the microwave interactive layer 40. The adhesive may also be placed on the central panel 90 in addition, or in lieu of the placement of the adhesive on the panels 92, 94. In forming, the hot melt adhesive is placed on the insert blank and the flaps are folded over in juxtaposition to the central panel 90 prior to hardening of the adhesive such that upon hardening of the adhesive the flaps 92, 94 are affixed to the central panel 90 by the adhesive 2. Various forms of adhesive may be utilized, however it has been found that a hot melt adhesive having a relatively low melting point is particularly suitable for the present invention. The adhesive may be placed in a line as shown in FIG. 3, or also may be placed in spots at one or more locations on the insert blank for restraining each of the flaps. It should be understood that a small quantity of adhesive is utilized since the adhesive is melted during cooking, and if an excessively large amount of adhesive is utilized, there is a risk that the adhesive may melt and run onto the food product. Thus, only a small amount of adhesive is utilized.

In the carton of FIG. 1, the bottom panel 83 is also preferably laminated with a microwave interactive layer such that both the upper and lower surfaces of the food product may be browned. The food product is maintained in contact with the bottom layer 83 by virtue of the weight of the food product, and the upper surfaces of the food product are maintained in contact with the microwave interactive layer of the insert by virtue of the bias means 20 which are unrestrained after the adhesive has been at least partially melted. If desired, the shielding device 22 may be omitted and a microwave interactive layer may be laminated on the interior of the side walls 62, 64, 66, 68 to provide browning on side surfaces of the food product. Of course, where only browning of the top of a food product is desired (pies, for example), the bottom and side microwave interactive layers can be eliminated.

FIGS. 4A–4B show an alternative embodiment of the insert in accordance with the present invention. As shown in FIG. 4A, the insert includes a substantially rectangular panel 120 with vents 122 cut through the panel. The vents 122 allow vapor to be removed from the area adjacent the food product, since such vapors may make the food product soggy. In addition, the vents can prevent a pressure build up below the insert which may have a tendency to force the insert upwardly away from contact with the surface of the food product. Extending from the panel 120 and contiguous therewith are side biasing flaps 126, 128 which are demarcated by crush or fold scores 125, 127. As shown in FIG. 4B, the biasing flaps 126, 128 are folded over onto central panel 120 and glued as shown at 2' to restrain the flaps forming the biasing means.

FIG. 5 shows a cross-sectional view of a container 130 having an insert 1', as shown in FIG. 4B, inserted atop a plurality of articles such as sausages 131. When the package is placed in a microwave oven, the microwave energy heats the microwave interactive layer on the insert 1' which will cause the hot melt adhesive 2' to melt releasing panels 126, 128 to insure contact of the central panel 120 with articles. Particularly where the articles shrink during cooking, the bias means comprising flaps 126, 128 will urge the central panel 120 downwardly toward the articles. If the bias means were not present, contact of the central panel 120 with the food product articles would not be assured, since heat or bubbling of the articles may urge the panel away from the articles, or edges of the panel may be frictionally engaged with side portions of the carton such that the panel having a microwave interactive layer could become skewed out of contact with the articles.

Figure 10:
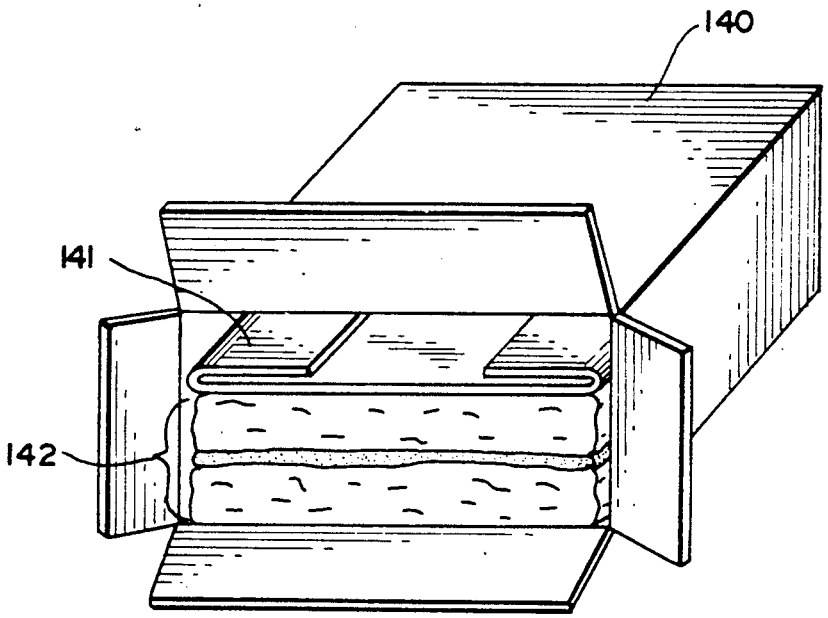
FIG. 10 is a perspective view of an end loaded carton having a restrained paperboard spring insert.

As shown in FIG. 10, the insert of the present invention is particularly suitable for end loading of a carton 140. The insert 141 may conveniently be slid into the container atop a food product, such as a sandwich 142 without special packaging apparatus for restraining the insert flaps since the adhesive or bias restraining means restrains the flaps during packaging. In addition, the insert may simply be placed atop the food product prior to packaging such that the insert and food product may be loaded in a single operation. The biased food contact insert can be particularly advantageous in cooking articles in which the top surface of the article is somewhat resilient, since the top surface of the article will conform somewhat to the central panel of the insert thereby increasing the browning area. Moreover, in food products such as a grilled cheese sandwich, the carton 140 and insert 141 may be sized substantially to the dimensions of the sandwich since excessive carton room is not required for orientation of the insert 141 during packing.

If desired, during the packing operation, the insert 141 may be placed in the carton 140 in a somewhat angular orientation thereby taking advantage of the increased diagnonal size of the carton head space, while interference of the bias flaps of the insert is not a problem since they are restrained by adhesive. Thus, since the insert may be placed in the carton at an angular position, insertion by automated machinery need not be as precise, since when the insert is at an angle with respect to the carton 140, more horizontal clearance is provided. Once in the carton, even if the insert does not lay flat atop the article, once the bias restraining means is released during cooking, the bias means will urge the central panel of the insert into contact with the food article.

Figure 6:
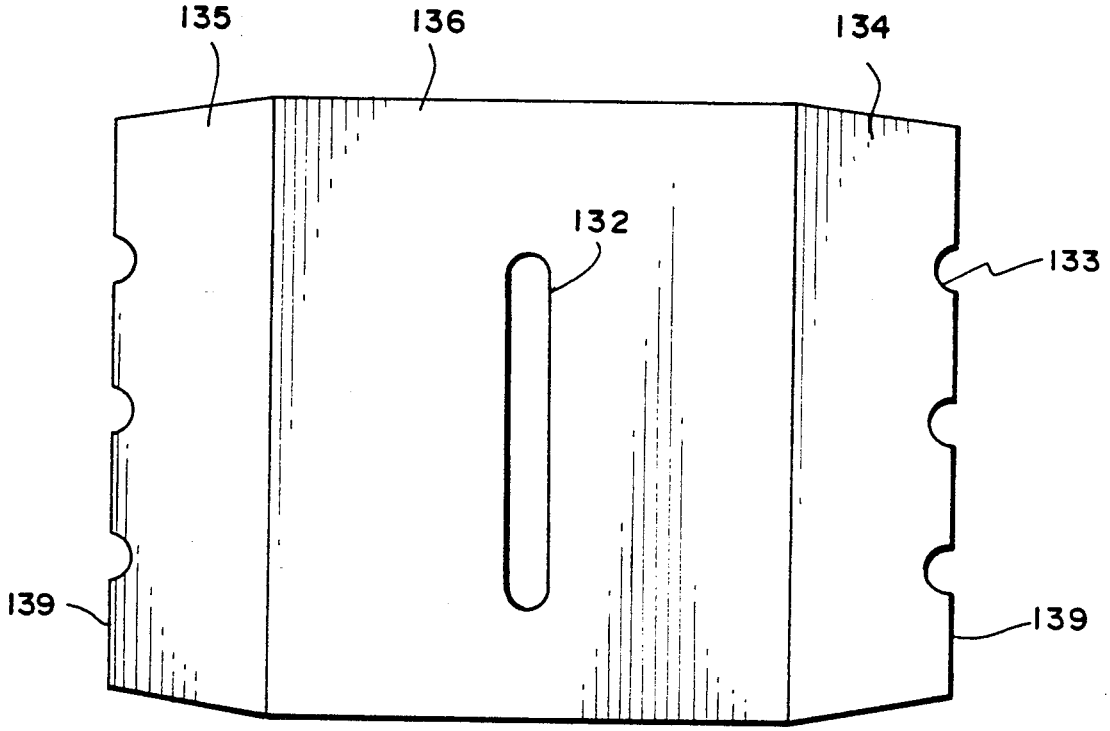
FIG. 6 is a schematic layout of an alternative blank.

FIG. 6 shows yet another embodiment of an insert in accordance with the present invention. In FIG. 6, an elongated vent hole 132 is utilized and semicircular portions are cut out as shown at 133. This arrangement provides even further venting of moisture or gas pressure within the package to minimize differential pressures within the package which may reduce the contact of the central panel 136. In addition, since the increased venting area allows moisture to flow away from the food product, the browning or crisping of the food product is further improved since the moisture may tend to make the exterior surface of the food product soggy.

Figure 7:
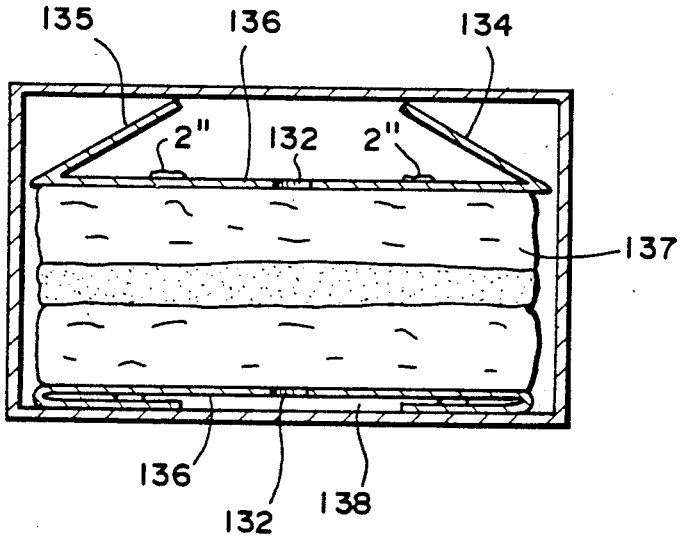
FIG. 7 is a cross-sectional view of a package which includes a pair of paperboard spring inserts.

As shown in FIG. 7, the insert may be utilized both above and below the food article such as a sandwich 137. This arrangement is particularly advantageous since the use of a double insert can provide browning to both upper and lower portions of a food product in a container which was not previously manufactured to include a microwave interactive layer. While in FIG. 7 two of the inserts of FIG. 6 are utilized, it is to be understood that any of the insert embodiments disclosed herein may be utilized in a two insert arrangement, or various combinations of two different inserts may also be utilized. In FIG. 7, the heating has already begun such that panels 134 and 135 are unrestrained and bias the central panel 136 into contact with the upper surface of the sandwich 137. Less biasing is exhibited in the lower insert due to the weight of the food product, however even the slight bias of the lower panel results in improved drainage of liquids which may ooze or seep from the food product during cooking. The elongated vent 132 allows such liquid to drain down into an area 138 below the food product. Cut-outs 133 will further aid in allowing the liquid to accumulate in the lower portion of the container since the cut-outs 133 can prevent the liquid from being retained between edge portions 139 of the flaps 135, 136. As also shown in FIG. 7, the adhesive 2'' melts releasing panels 134, 135, however the amount of hot melt utilized is kept to a minimum such that even in the melted condition adhesive does not run excessively. If a very small amount of adhesive is used, running of the melt is not exhibited.

Figure 8:
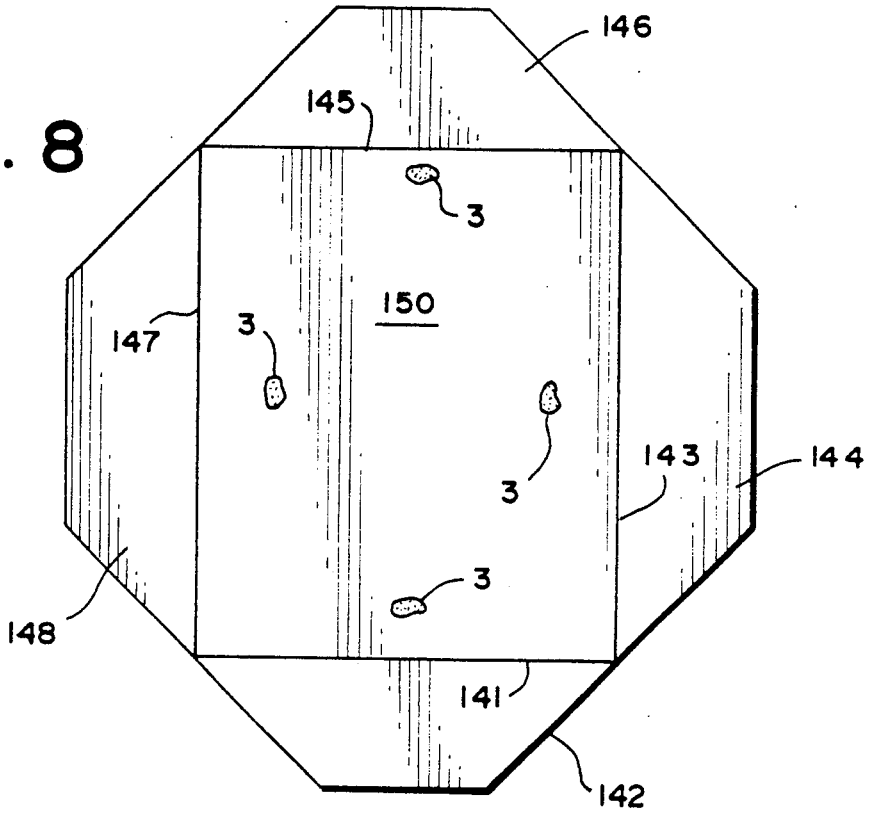
FIG. 8 is a schematic layout of yet another blank used for forming a paperboard insert.

FIG. 8 shows an insert with four biasing panels 142, 144, 146, 148 contiguous with a central panel 150 separated by fold scores 141, 143, 145, 147 respectively. As in the other inserts disclosed herein, the flaps are adhered to the central panel by an adhesive 3 which will release the flaps to bias the central panel 150 toward the food article when the adhesive 3 at least partially melts.

The embodiment of FIG. 8 is particularly suitable where excessive bowing or curling of an insert panel is known to occur. For example, where a large insert is utilized, or where irregularly shaped articles or food articles having extremely high moisture content are packaged, excessive bowing or curling of the central panel of the insert may occur thereby reducing the contact of the microwave interactive layer with the food product. The excessive bowing or curling is reduced by the use of two additional bias flaps oriented transverse to the first pair of bias flaps. Thus, an increased bias force is present with bowing or curling reduced since an additional pair 142, 146 of bias flaps are oriented transverse to a first pair of bias flaps 144, 148.

Figure 9A:
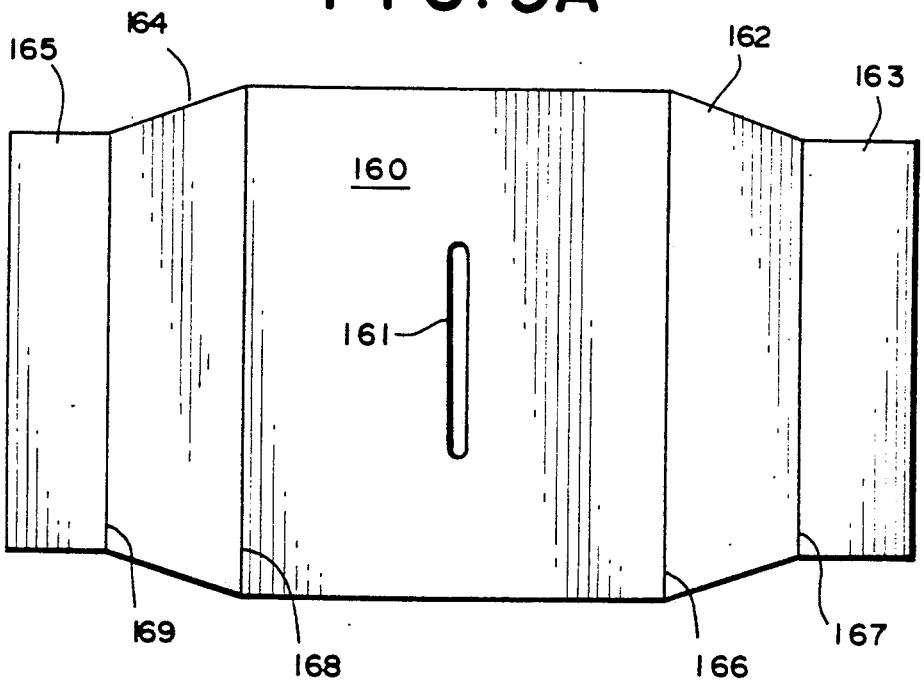
FIGS. 9A-9C show a further embodiment of a paperboard spring insert.
Figure 9B:
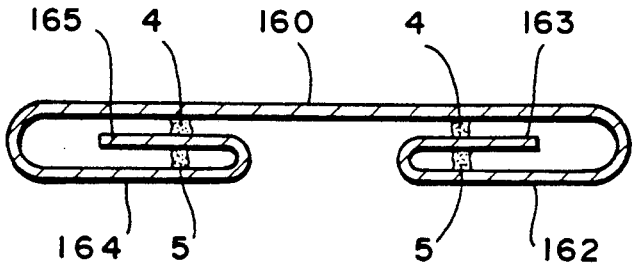

In the embodiment of FIG. 9A, a pair of bias or wing flaps 162, 163, 164, 165 extend contiguously from either side of a central food contact panel 160. The bias panels are separated from one another and from the central panel by fold score lines 166–169. The insert of FIG. 9A, as with the other inserts disclosed herein, may be utilized as both a top and a bottom panel as shown in FIG. 7. FIG. 9B shows a side view of the panel of FIG. 9A in a folded position with wing panels 163, 165 adhered to the central panel 160. Note that the food contact surface would be the top surface of the insert of FIG. 9B. Optionally, flaps 163 and 165 may also be adhered to the flaps 162, 164 by adhesive 5.

The blank of FIG. 9A is particularly suitable for food products having excessive liquid draining during cooking, since when the panel is utilized as a lower insert, additional space is provided in the lower portion of the container to collect liquids. Even where the weight of the food product maintains the insert in a substantially flat configuration, the central panel 160 is still maintained a greater distance from the container bottom as compared to the insert having a single flap at each end, since the additional flaps 163, 165 increase the distance between the central panel 160 and panels 162, 164. Thus, excessive liquid may be accommodated in the area underneath the central panel 160, which liquid may be drained through vent 161.

Figure 9C:
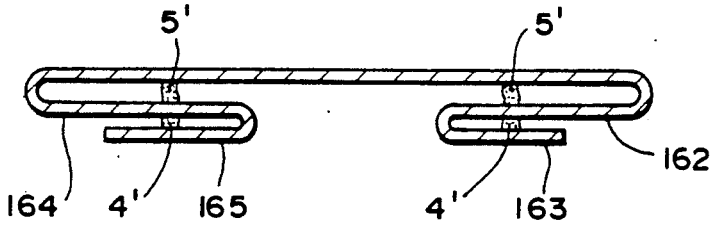

The peripheral flaps 163, 165, may also be outwardly folded and glued at 4', 5' as shown in FIG. 9C. This arrangement is particularly suitable where the food product shrinks a great deal, since the bias flaps 162, 165 can exert a spring force over a greater distance due to the increased combined length of the flaps of the bias means. The FIG. 9C arrangement also provides improved drainage as a bottom insert as discussed in connection with the FIG. 9B arrangement.

Industrial Applicability

This invention has particular utility in packaging of food for distribution, sale and microwave heating of food products in a single package. The bias food contact inserts make storage and handling of the inserts easier since the bias means are restrained prior to heating of the microwave package. Since handling is made easier, the inserts may be sold in bulk or may be conveniently placed in a carton and sold as part of a microwave package. Due to the ease in inserting the restrained bias food contact inserts, they may be formed for use in packages not previously formed with a microwave interactive layer to improve cooking of the food products within the package. Thus, the inserts may form part of a package or may be utilized to retrofit existing packages for improved microwave use. Not only is the ease in handling for packaging improved, but also the biasing effect of the insert may be improved since the bias flaps or wings are not continually flexed with respect to the central insert panel by the force of the food product, as when the packages are shaken or turned over during shipping and handling.

I claim:

1. An insert for a microwave package comprising:
a panel;
microwave interactive means for converting microwave energy into heat, said microwave interactive means including a microwave interactive material associated with said panel;
bias means for imposing a spring force upon said panel; and
restraint means for restraining said spring force such that said spring force is not imposed on the panel at temperatures within a first range associated with shipping and storage of the insert, said restraint means including means for releasing said spring force at temperatures higher than those in said first range associated with microwave cooking, such that a spring force is imposed between said panel and a wall of a container in which said insert is enclosable upon releasing said spring force wherein said panel is urged positively by said biasing means into contact with a surface of a food product also enclosable in said container.

2. The insert of claim 1, wherein said restraint means restrains the spring force at a first temperature and releases the spring force at a second temperature which is higher than said first temperature.

3. The insert of claim 2, wherein said bias means includes at least one flap contiguous with said panel;
said insert further including a fold line separating said at least one flap and said panel.

4. The insert of claim 1, wherein said bias means comprises a pair of flaps contiguous with said panel;
said insert further including a pair of fold lines each separating a separate one of said flaps and said panel.

5. The insert of claim 1, wherein said restraint means comprises a hot melt adhesive which restrains the spring force in a cooled hardened condition and which releases said spring force when heated such that at least a portion of the adhesive is melted, said hot melt assuming said cold hardened condition at temperatures associated with storage and assuming the condition in which at least a portion of the hot melt is melted at temperatures associated with cooking.

6. The insert of claim 4, wherein said panel and said pair of flaps are formed from a single blank, said blank including two surfaces, said microwave interactive means including a layer of microwave interactive material on one of said two surfaces.

7. The insert of claim 3, wherein said restraint means comprises an adhesive affixing each of said flaps to said panel.

8. The insert of claim 1, wherein said bias means includes:
a first plurality of contiguous flap members extending from and contiguous with a first edge of said panel; and
a second plurality of contiguous flap members extending from and contiguous with a second edge of said panel.

9. The insert of claim 8, further including a plurality of fold lines, said fold lines demarcating each of the respective flap members of said first and second pluralities and also demarcating said first and second pluralities from said panel.

10. The insert of claim 1, wherein said panel includes four edges, said bias means including four flaps, each contiguous with a separate one of said four panels.

11. The insert of claim 1, wherein said restraint means imposes a controllably variable restraining force on said bias means.

12. A package for use in heating food by microwave energy comprising:
carton means for forming an interior food cavity;
an insert located within said food cavity, said insert comprising:
(a) a panel;
(b) bias means for imposing a spring force between said panel and said carton means;
(c) microwave interactive means for converting microwave energy into heat, including a microwave interactive material associated with said panel; and
(d) temperature sensitive restraint means for restraining said spring force between said panel and said carton means at a first temperature and for releasing said spring force at a second higher temperature such that at a first temperature the bias means does not impose a spring force between said panel and said carton means, and upon release of said spring force a spring force is imposed between said carton means and said panel wherein said panel is then urgeable positively into contact with a surface of food placed within said food cavity.

13. The package of claim 12, wherein said carton means includes a top wall, said bias means biasing said panel away from said top wall.

14. The package of claim 12, wherein said restraint means includes an adhesive.

15. The package of claim 12, further including a second insert located within said food cavity, said second insert including a second panel;
second bias means for imposing a spring force between said second panel and said carton; and
a microwave interactive material associated with said second panel.

16. The insert of claim 12, wherein said bias means includes at least one flap contiguous with said panel; and
a fold line separating said at least one flap and said panel.

17. The package of claim 12, wherein said bias means comprises a pair of flaps contiguous with said panel.

18. The package of claim 12, wherein said restraint means is a hot melt adhesive.

19. The package of claim 12, wherein said bias means includes:
a first plurality of contiguous flap members extending from and contiguous with a first edge of said panel; and
a second plurality of flap members extending from and contiguous with a second edge of said panel.

20. The package of claim 12, wherein said panel includes four edges, said bias means including four flaps, each contiguous with the separate one of said four panel edges.

* * * * *